US006637250B2

(12) United States Patent
Plata et al.

(10) Patent No.: US 6,637,250 B2
(45) Date of Patent: Oct. 28, 2003

(54) DEVICE FOR MANUFACTURING A METAL PROFILE

(75) Inventors: Miroslaw Plata, Vetroz (CH); Christophe Bagnoud, Veyras (CH); Gregoire Arnold, Miege (CH); Martin Bolliger, Venthone (CH)

(73) Assignee: Alcan Technology & Management Ltd, Neuhausen am Rheinfall (CH)

( * ) Notice: Subject to any disclaimer, the term of this patent is extended or adjusted under 35 U.S.C. 154(b) by 0 days.

(21) Appl. No.: 10/163,771

(22) Filed: Jun. 4, 2002

(65) Prior Publication Data

US 2002/0189313 A1 Dec. 19, 2002

(30) Foreign Application Priority Data

Jun. 7, 2001 (EP) ..... 01810547

(51) Int. Cl.[7] ..... B21C 27/00

(52) U.S. Cl. ..... 72/272; 72/257; 72/271; 72/342.1; 72/364

(58) Field of Search ..... 72/253.1, 257, 72/270, 271, 272, 286, 342.1, 342.92, 364; 266/103, 106, 249

(56) References Cited

U.S. PATENT DOCUMENTS 3,113,676 A * 12/1963 Harkenrider ..... 72/270
3,668,748 A 6/1972 Divecha et al.
3,874,207 A * 4/1975 Lemelson ..... 72/56
4,462,234 A * 7/1984 Fiorentino et al. ..... 72/41
5,031,437 A * 7/1991 Elhaus et al. ..... 72/257
5,473,925 A * 12/1995 Yano ..... 72/262
6,360,576 B1 * 3/2002 Plata et al. ..... 72/270

FOREIGN PATENT DOCUMENTS

EP 0 839 589 5/1998
GB 1 340 122 12/1973

OTHER PUBLICATIONS

Patent Abstracts of Japan, vol. 1997, No. 01, Jan. 31, 1997 & JP 08 243634 A (Showa Electric Wire & Amp Co. Ltd) Sep. 24, 1996.

Patent Abstracts of Japan, vol. 014, No. 103, Feb. 26, 1990 & JP 01 309717 A (Furukawa Electric Co. Ltd.) Dec. 14, 1989.

* cited by examiner

*Primary Examiner*—Ed Tolan
(74) *Attorney, Agent, or Firm*—Bachman & LaPointe, P.C.

(57) ABSTRACT

An extrusion device for manufacturing a profile from an extrusion block (36), which is at least in part of metallic material, contains a container (10) with container bore (12) to accommodate an extrusion block (36), a stem (32), a shaping chamber and/or a shaping die (18) and a heating facility (25) arranged between the container bore (12) and the die (18). The heating facility (25) contains a heating chamber (22) in the form of a hollow metal tube featuring at least a first and a second heating section **(22*a*, 22*b*) with heating chamber walls (26*a*, 26*b*) and means (30) for inductively heating the heating chamber walls (26*a*, 26*b*). The first heating section (22*a*) exhibits a larger cross-sectional diameter than the—with respect to the direction of extrusion x—second heating section (22*b*)**, forming thereby a step-like narrowing in cross-section.

23 Claims, 1 Drawing Sheet k
x
42
44
40
24
28
18
26b
22b
38
22
9
4
25
30
22a
26a
20
5
12
36
14
34
10
32
50
LF [%]
0
500
p [bar]
0
1
2
a
b
c
d
e
f

DEVICE FOR MANUFACTURING A METAL PROFILE

BACKGROUND OF THE INVENTION

The present invention relates to a extrusion press device for manufacturing a profile from an extrusion block of a material that is at least in part metallic, whereby the extrusion press device contains a container with a container bore for acommo-dating the extrusion block, a stem, a shaping chamber and/or die and a heating facility situated between the container bore and the die or shaping chamber, and relates also to a process for manufacturing a metal profile.

The production of metal profiles via the extrusion process is a technology known to experts in the field, whereby however the production of large profiles made of aluminum alloys and having a breadth of more than 700 mm is associated with many technical problems.

Further, it is hardly possible to produce profile wall thicknessess smaller than 2 mm using state-of-the-art extrusion technology. In view of the savings in weight and costs, however, it is highly desirable to be able to reduce the wall thickness of profiles i.e. while maintaining the normal geometric tolerances of the profile to achieve wall thickness of less than 1 mm. Limited extrusion force and limited possibilities of achieving uniform distribution of metal due to temperature distribution and flow rates are the esential factors that oppose the production of very thin walled profiles using present day technology.

With current extrusion technology, however, production of profiles of medium and smaller breadth is also to a certain extent limited in terms of the material employed and cross-sectional dimensions. For example, high strength aluminum alloys can hardly be extruded, or if so only with great difficulty, with the extrusion forces avail-able in conventional extrusion presses. These limitations apply in particular for extrusion of hollow profiles, especially multi-chamber hollow profiles. In addition, failure to meet dimensional tolerances and poor distribution of metal are problems frequently encountered and are due to insufficient filling of the die in parts of the profile with small cross-sectional dimensions.

Using the extrusion method as a way for processing metal-based, particle-reinforced composites containing particles or non-metallic, high melting point fibres dispersed in the metal matrix, results in problems comparable to those described above when processing high strength alloys. In the publications WO-A-87/06624, WO-A-91/02098 and WO-A-92/01821 a detailed description is provided of the production of these so-called "metal matrix composites". Thereby, the particles to be embedded in the metal matrix are first stirred homogeneously into an alloy melt. The molten composite material is then cast e.g. continuously cast into a format suitable for further processing by extrusion.

In WO98/19803, as a solution to the above mentioned problem, an extrusion process is proposed in which the extrusion block in the part-solid/part-liquid state is shaped into a profile. In order to reach a part-solid/part-liquid state, prior to extrusion, the extrusion block is pressed through the through-flow channels of a heating element for the purpose of being heated. However, pressing the initially still solid block material through the through-flow channels requires very large extrusion forces, and there is a marked reduction in pressure in the region of these through-flow channels. Apart from the large extrusion forces that are necessary, the control of the extrusion process is made considerably more difficult as a result of the local drop in pressure. Further, the distribution of the fluid fraction of the block, after passing through the heating element in the semi-solid state, is difficult to control and is as a rule inhomogeneous.

The object of the present invention is to improve the above mentioned process and to reduce the reduction in pressure in the heating element. Further, the extrusion of blocks of thixotropic alloys in the part-solid/part-liquid state should be simplified while achieving as homogeneous as possible distribution of the liquid fraction.

SUMMARY OF THE INVENTION

The foregoing object is achieved by way of the invention in that the heating facility contains a heating chamber which is in the form of a hollow body arranged, with respect to the direction of extrusion, after or immediately following the container and features at least a first and a second heating section with heating chamber walls and means for heating the heating chamber walls, and the first heating section exhibits a larger cross-sectional diameter than the subsequent, with respect to the direction of extrusion x, second heating chamber section.

The heating chamber contains preferably less than five sections, advantageously less than four sections, and in particular two sections. At least one of the heating sections, preferably all heating sections, are of larger cross-sectional diameter than the heating section that follows immediately in the direction of extrusion x, this of course with the exception of the first section of the heating chamber. The transition zone between two heating sections of different diameter is characterised by way of a sudden, complete or partial narrowing in cross-section. In a particularly preferred version of the invention the narrowing in cross-section is in the form of a ledge or step extending over the whole periphery or a part of the periphery of the heating chamber cross-section. If several sections of heating chamber are provided, then a sudden narrowing in cross-section, e.g. in the form of a ledge or step, may be provided in all or several transition zones between two heating sections, whereby as described above the narrowing takes place in the direction of extrusion x.

The narrowing may also run continuously e.g. tapered and if desired exhibit a roughness pattern. Further, the narrowing of the cross-section may be made in several steps.

The narrowing in cross-section amounts preferably to around 5 to 40%, advantageously 15 to 30%, in particular 20 to 30% of the cross-sectional diameter of the aforegoing heating chamber section. Advantageously, the overall length of the heating chamber amounts to 2–4 times the length of the extrusion block, in particular 2.5–3.5 times that length.

The cross-sectional shape and diameter of the first section of the heating chamber immediately following the container is essentially, preferably exactly the cross-sectional shape and diameter of the container bore. The extrusion block is prefer-ably in the form of a billet, whereby the cross-sectional shape of the container bore and the neighbouring first heating section that follows the container bore are cylindrical in shape. The subsequent heating sections are preferably likewise cylindrical in shape. The cross-sectional shape of the heating sections, in particular the heating chamber sections near the die may be differently shaped e.g. elliptical in shape.

In a special version of the invention the shape of the heating sections may approach that of the cross-section of the profile in question. In a preferred version a first section of the heating chamber corresponds in cross-sectional shape and diameter of to that of the container bore and the following sections of the heating chamber, in particular the section or sections of the heating chamber next to the die approach the cross-sectional shape and cross-sectional diameter of the profile, this in a stepwise manner in the direction of extrusion x. By making the shape of the extrusion block approach the shape of the profile cross-section before the actual shaping in the die, there is a reduction in the amount of force required at the die to shape-form the block. If a heating chamber section does not exhibit a cylindrical cross-section, then by cross-sectional diameter is to be understood the mean cross-sectional diameter.

The heating chamber of an extrusion device according to the invention for manufacturing a rectangular profile may e.g. exhibit a first cylindrical heating section next to the container core and a elliptical shaped heating section that approaches the shape of the profile next to the die.

The heating chamber is to advantage in the form of a hollow, heat-resistant metallic, in particular steel, tube. The hollow tube is to advantage made of a ferromagnetic steel, especially a nickel-cobalt-chromium steel.

The container bore and in particular the heating chamber are preferably clad with a heat resistant insulating material or are made of a ceramic material. Highly preferred is an insulating cladding of carbon fibre reinforced ceramic material with good insulating properties.

The heating of the heating chamber walls is performed preferably via inductive heating. For that purpose the heating chamber or metallic hollow tube of the heating chamber is advantageously surrounded by an induction coil. The induction coil windings are wrapped, in particular in a spiral form, around the metallic hollow tube with the insulating cladding. The applied induction field effects in particular the heating of the metallic hollow tube and with that the heating of the chamber walls. The heating of the heating chamber walls may if desired also be achieved using other methods of heating such as resistance heating.

Likewise, the container or the container bore wall advantageously exhibits heating elements such as e.g. wires for heating the extrusion block introduced into the bore, whereby the heat transfer to the extrusion block takes place via the container bore wall.

In a particular version of the invention the inner wall of the heating chamber facing the extrusion block material exhibits relief structures advantageously grooves or ribs running essentially in the direction of extrusion, in particular spiral-shaped grooves or ribs running in a spiral shape round the wall in the direction of extrusion. The above mentioned grooves, ribs or relief structures contribute to an increase in the surface of the heating chamber walls and effect better transfer of heat from the heating chamber walls to the extrusion block material. The orientation of the relief structures in the direction of extrusion causes smaller frictional losses so that the loss in pressure in the heating chamber is kept within limits.

The die with its shape-forming opening is to advantage situated close to or immediately next to the heating chamber. The die usefully exhibits a tapered, funnel-shaped narrowing in cross-section up to the die opening.

In a further version of the invention a likewise heated, in particular inductively heated shaping chamber is provided after the heating chamber, in which the pre-heated and in particular part-solid/part-liquid extrusion block material is formed into a profile. The shaping chamber maybe in the form of part of the heating chamber on the end section of the heating chamber in the direction of extrusion x and in the form of a further heating chamber section.

Provided directly after the shaping chamber may be a cooled mould in which the heated and in particular part-solid/part-liquid extrusion is stabilised. Such a mould which may basically correspond to a conventional casting mould is usefully fitted with a cooling device for indirect cooling of the solidifying metal strand due to contact with the mould wall.

The shaping chamber wall preferably curves in a continuous manner up to the mould wall. In order to manufacture hollow profiles the shaping chamber may be provided with a mandrel part as in conventional extrusion. An intermediate element or layer of thermally insulating material may be provided between the shaping chamber and the cooled mould.

Provided directly after the shaping chamber or mould is a die in which the profile is shaped into its final form. Optionally, however, the die may be dispensed with in this case. Further details concerning the configuration and make up of shaping chamber and mould can be seen in WO 98/19803, which hereby overall is part of the patent publication.

Means for direct cooling the profile emerging from the die, e.g. a coolant, prefer-ably a cooling device providing complete vaporisation of a coolant applied to the profile, may be foreseen.

As the pressure on the extrusion block i.e. the compressive force for example resulting from the high temperatures—up to 600° C.—necessary for special additions may not be increased without limitation, an advantageous further development of the device according to the invention is such that the pressing of the extrusion block into a profile may be reinforced by a tensile force applied to assist the extrusion of the block into the form of a profile. A pulling device may be provided in order to apply a tensile force k to the profile.

The invention also relates to a process for manufacturing a profile made at least in part of a metallic material, whereby the extrusion block is introduced into the bore of a container and pressed—by a stem which applies a compressive force—into a shaping chamber and/or die and into the form of a profile whereby, prior to extrusion into a profile, the extrusion block is pre-heated and in particular transferred into a part-solid/part-liquid state.

The process is characterised in that the extrusion block is passed out of the container bore into the heating chamber of a heating device and preheated via inductively heated heating chamber walls, and the heating chamber contains a first and a second section and, as a result of narrowing of the cross-section, the second section of the heating chamber with respect to the direction of extrusion x exhibits a smaller cross-sectional diameter than the aforegoing, first heating section, and at the narrowing of the cross-section counter to the direction of extrusion a zone of poor flow is formed in which pre-heated and in particular part-liquid or liquid extrusion block material is kept back.

The pre-heating of the extrusion block in the heating chamber serves to soften the block or to increase its ductility and in the case of thixotropic alloys to transform the block to a part-solid/part-liquid state.

The block is preferably heated in the container core to a temperature below or at the solidus temperature or, if this has already been pre-heated, reheated to or held at the pre-heat temperature. The device according to the invention, however, permits in particular the processing of blocks that have not been pre-heated.

The use of stems enables the block to be advanced in a continuous manner into the container bore under application of pressure, whereby the stem is preferably advanced only up to the end of the container bore. The rate of advance may e.g. be around 5–10 mm/sec.

The block is heated further via the area in contact with the inductively heated heating chamber wall, preferably to a temperature that lies above the solidus. The amount of inductive heating is chosen such that preferably only the metallic hollow tube of the heating chamber and if desired the peripheral zone of the block lying against the heating chamber wall are directly inductively heated. It is also possible that the whole cross-section of the block is intentionally inductively heated.

Usefully, as the heating process progresses, first a melt product with a high liquid fraction is formed in the region of the heating chamber wall. In the so called "dead zone" the sudden narrowing in cross-section between two heating chamber sections i.e. in the space exhibiting poor flow characteristics before the narrowing in cross-section, the phase of the block material with the high liquid fraction near the wall of the heating chamber is held back, while the still solid or semi-solid block material with the small fraction of liquid fraction flows from the middle of the cross-section into the next narrower cross-section of the heating chamber and is heated up further.

The device according to the invention effects efficient and uniform heating of the block material from the outside of the cross-section to the middle of the cross-section and with that a homogeneous distribution of the liquid fraction over the whole cross-section of the still part-solid/part-liquid block material in the region of the entrance to the shape-forming chamber or die. The partially liquid to fully liquid block material in the "dead zone" in the narrowing of the cross-section also improves the exchange of heat between the wall of the heating wall and the block material.

In a first version of the device according to the invention the part-solid/part liquid block material flows from the heating chamber into the shape-forming cross-section of the die and is shaped into its final form as a profile in the shape-forming opening in the die. Immediately on emerging from the die the profile is directly and/or indirectly cooled by a cooling facility and if desired pulled by means of a pulling facility applying a tensile force, then transferred for further processing.

In a second version of the device according to the invention the part-solid/part-liquid block material is passed from the heating chamber through a shaping chamber, which follows immediately and is separate or part of the heating chamber, and shape-formed into a profile. In a mould immediately following the shaping chamber the profile is cooled and partially or completely solidified. Optionally, the partially or completely solidified profile is shaped into its final form in a subsequent die.

The material of the block on leaving the heating chamber, i.e. on entering the shaping chamber or die, preferably exhibits a homogeneous fraction of liquid phase which amounts at most to 70%, advantageously 20–60%, and in particular 40–50% of the whole. The exact liquid fraction of block material desired for shape-forming purposes depends on the characteristics of the material to be processed and on the cross-section of the profile to be manufactured.

After leaving the die, the profile is usefully actively cooled, preferably by complete vaporisation of a coolant sprayed onto the profile. The cooling by complete vaporization of the coolant ensures that coolant cannot run back in the direction of the hot and possibly still partly molten metal. This enables the coolant facility to be situated as close as possible to the die.

With the device according to the invention it is possible to process e.g. the following materials:

- wrought alloys of aluminum, e.g. naturally hard or age hardenable wrought aluminum alloys;
- alloys, in particular aluminum and magnesium alloys in the thixotropic state, such as hard alloys of the AlMg or MgAl type;
- alloys base on magnesium or copper in the thixotropic state;
- non-thixotropic hard alloys of aluminum or magnesium, in particular an AlMg or MgAl alloy;
- alloys based on aluminum or magnesium with fractions of metallic or non-metallic high-melting point particles and/or fibres (metal matrix composites). Preferred non-metallic additions are ceramic materials such as metal oxides, metal nitrides and metal carbides. Examples of such materials are silicon carbide, aluminum oxide, boron carbide, silicon nitride and boron nitride. These additions enable e.g. the hardness and the rigidity of the material to be influenced.

The use of pre-heated blocks or blocks in the part-solid/part-liquid state offers the advantage over conventional, completely solidified extrusion billets that the deformation of the material can be performed with much lower extrusion forces.

Using the process according to the invention it is possible with the same force to extrude materials into profiles that are hardly possible using conventional extrusion presses, or if so then only in an uneconomic manner. Further, using the device described here the loss in pressure between the container core and the die opening is small, with the result that due to this alone smaller extrusion forces are required. Consequently, in comparison with conventional ways of manufacture, profiles of comparable dimensions can be extruded on smaller production facilities.

The device according to the invention makes it possible to process in particular hard alloys and composite materials of all kinds into high quality products in a cost favourable manner. Further, it is possible using the device according to the invention to manufacture very thin walled profiles or profiles with very thin walled parts exhibiting wall thicknesses e.g. of less than 2 mm, in particular less than 1 mm. Using the process according to the invention it is possible to produce small and large profiles of a wide variety of breadths in particular large profiles of large breadth, e.g. of greater than 500 mm, in particular larger than 700 mm. Also existing extrusion presses may be converted into extrusion press devices according to the invention at reasonable cost.

BRIEF DESCRIPTION OF THE DRAWINGS

The invention is explained in greater detail in the following and with reference to the accompanying drawings. These show.

DETAILED DESCRIPTION OF PREFERRED EMBODIMENT(S)

Figures 1A, 1B:
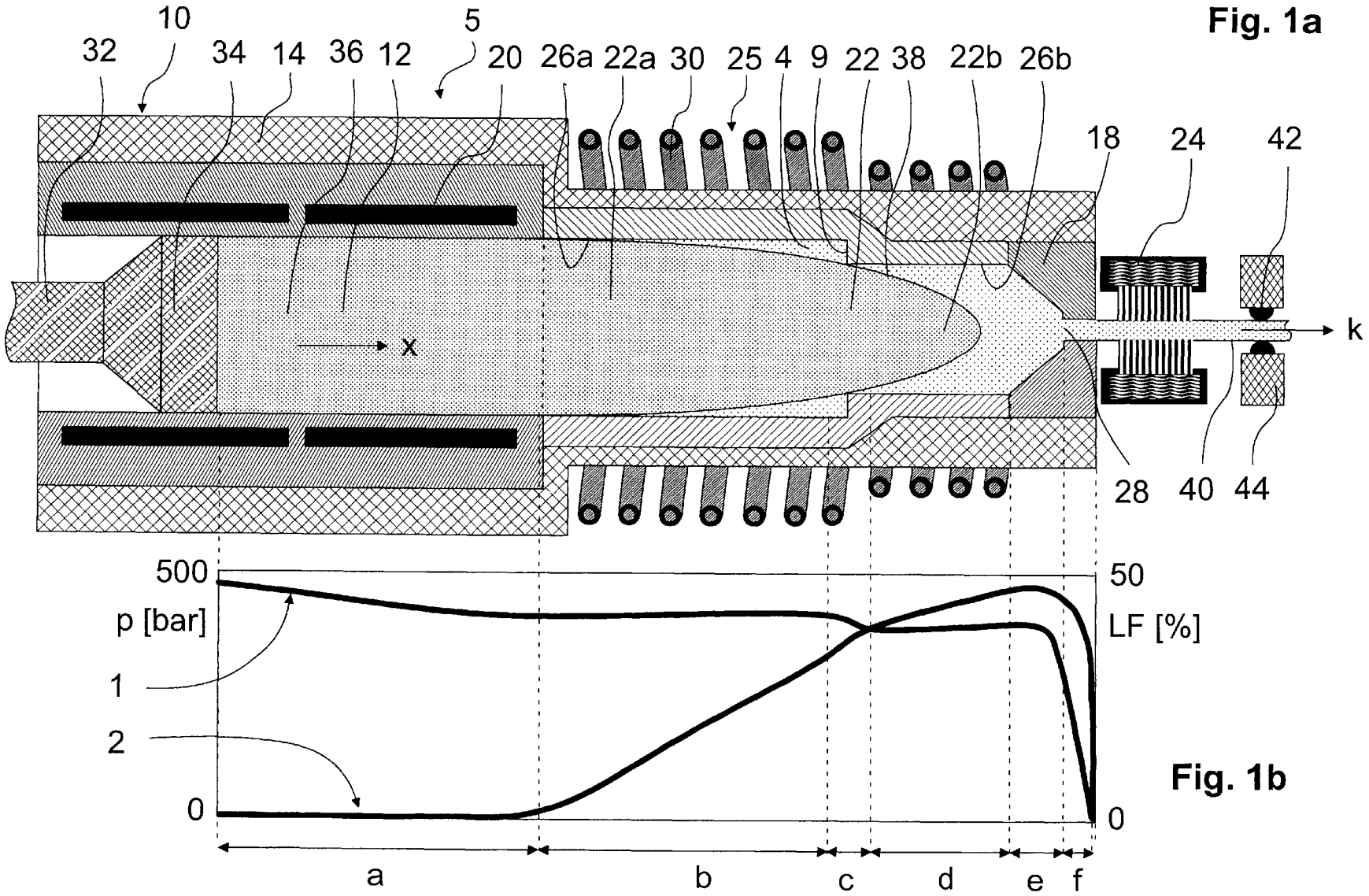
FIG. 1*a*: a cross-section through a section of an extrusion press device according to the invention.
FIG 1*b*: a graphic representation of the change in extrusion force P and the fraction LF of block material in the liquid state within the extrusion press device.

An extrusion press device 5 according to the invention shown in section in FIG. 1*a* contains a container 10 with bore 12 which is circular in cross-section. The container 10 also includes heating elements 20 in the form of heating wires for heating the extrusion block 36 inserted in the container bore 12. The extrusion block is advanced in the direction of extrusion x by the stem 32 or its dummy block 34. Following immediately after the container bore 12 is the heating facility 25 with a heating chamber 22 which is circular in cross-section and comprises a first heating chamber section 22*a* and a second heating chamber section 22*b*. The diameter of the first heating section 22*a* is equivalent to the diameter of the container bore 12. There is a narrowing in cross-section 9 from the first heating section 22*a* to the second heating section 22*b* of the heating chamber, whereby the diameter of the second heating section 22*b* is around 25% smaller than the diameter of the first heating chamber section 22*a*. The narrowing in cross-section 9 is shown as a ring-shaped step running round the whole periphery.

The first heating chamber section 22*a* has a length of around ⅔ and the second heating chamber section 22*b* a length of ⅓ of the overall length of the heating chamber. The heating chamber 22 is in the form of a hollow cylindrical steel body. Both the walls of the container bore 12 and those of the heating chamber 22 are clad on the outside with heat resistant insulation 14 or ceramic materials.

The hollow cylindrical shaped steel body of the heating chamber 22 is surrounded by an induction coil 30 by means of which the inductive force for heating the heating chamber walls 26*a*, 26*b* is generated. The metallic hollow cylinder of the heating facility 25 is heated to a temperature e.g. of around 600–700° C. The extrusion block material is introduced into the heating chamber 22 in a part-solid/part-liquid state, whereby in the first heating section 22*a* the liquid fraction is greatest in the region of the heating chamber walls. This phase of partially liquid extrusion block material in the region of the heating chamber wall 26*a* is also held back at the narrowing in the cross-section 9 in the so called slack flow zone 4 also known as the "dead zone" while the more solid extrusion block material from the middle of the cross-section flows into the second section 22*b* of the heating chamber. This process is indicated by a schematic softening front 38 which separates extrusion block material of high liquid fraction at the periphery from that of low liquid fraction in the middle.

Provided after the heating chamber 22 is a shaping chamber and/or die 18, through the opening 28 in which the extrusion block material is passed into the shape-forming cross-section. The profile 40 emerging from the shaping chamber and/or die 18 is passed through a cooling facility 24 and actively cooled by means of a coolant. A pulling facility 44 is provided where the profile 40 leaves the die 18. In order to support the extrusion process, a tensile force k is applied via drive rolls to the exiting profile 40 in the direction of extrusion x.

Shown in FIG. 1*b*—on the basis of a modeling calculation for the arrangement in FIG. 1*a*—are the progress of the extrusion force (p) and the liquid fraction (LF) 2 in the extrusion block material within the extrusion device 5, whereby "*a*" represents the section in the container bore 12, "*b*" represents the section in the first heating chamber section 22*a*, "*c*" represents the section at the narrowing in cross-section 9, "*d*" represents the section in the second heating chamber section 22*b*, "*e*" represents the section of tapered inlet to the die and "*f*" represents the section in the die opening.

In a device serving as an example the stem 32 operates with a pressure of around 500 bar. Up to the die opening 28 there is no significant drop in compressive force. Only in the region of the narrowing 9 in cross-section is there a slight drop in pressure over a small distance.

The temperature of the extrusion block material in the container bore 12 lies below or at the solidus temperature, with the result that no liquid phase is formed yet. In the heating chamber 22 the fraction of liquid phase increases continuously especially in the peripheral region, whereby the extrusion block material in the region of the die reaches a homogeneous liquid fraction of around 45–50%.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An extrusion press device for manufacturing a profile from an extrusion block (36) of a material that is at least in part metallic, whereby the extrusion press device (5) contains a container (10) with a container bore (12) for accommodating the extrusion block (36), a stem (32), a shaping means (18) and a heating facility (25) situated between the container bore (12) and the shaping means, the improvement comprising:

the heating facility (25) contains a heating chamber (22) in the form of a hollow body arranged, with respect to the direction of extrusion x, following the container (10) and includes at least a first and a second heating section (22*a*, 22*b*) with heating chamber walls (26*a*, 25*b*) and means (30) for heating the heating chamber walls (26*a*, 26*b*), wherein the first heating section (22*a*) exhibits a larger cross-sectional diameter than the second heating section (22*b*) with respect to the direction of extrusion x, wherein a transition which includes a step is between the first heating section and the second heating section.

2. A device according to claim 1, wherein the heating chamber (22) is in the form of a hollow metallic body and the heating facility (25) contains means (30) for inductively heating the heating chamber walls (26*a*, 26*b*).

3. A device according to claim 2, wherein the means (30) for heating comprises induction coil windings around the heating chamber wall.

4. A device according to claim 1, wherein the cross-sectional diameter of the heating chamber section (22*a*) following on from the container bore (12) is substantially the same as the cross-sectional diameter of the container bore (12).

5. A device according to claim 1, wherein the heating chamber (22) is comprised of two heating sections (22*a*, 22*b*) and the length of the first heating section (22*a*) is about ⅔ of the overall length of the heating chamber and the length of the second heating section (2*b*) of smaller cross-section is about ⅓ of the overall length of the heating chamber.

6. A device according to claim 1 wherein the cross-sectional diameter of the second heating section (22*b*), following immediately after a first heating section (22*a*) with respect to the direction of extrusion x, is 5 to 40% smaller than the cross-sectional diameter of the heating section (22*a*) situated upstream.

7. A device according to claim 1, wherein the cross-sectional diameter of the second heating section (22*b*), following immediately after a first heating section (22*a*) with respect to the direction of extrusion x, is 15 to 30% smaller than the cross-sectional diameter of the heating section (22*a*) situated upstream.

8. A device according to claim 1, wherein the cross-sectional diameter of the second heating section (22*b*), following immediately after a first heating section (22*a*) with respect to the direction of extrusion x, is 20 to 30% smaller than the cross-sectional diameter of the heating section (22*a*) situated upstream.

9. A device according to claim 1, wherein the heating chamber (22) is a hollow metal tube.

10. A device according to claim 9, wherein the metal is selected from the group consisting of steel and chromium steel.

11. A device according to claim 1, wherein the cross-sectional shape of at least the heating chamber section adjacent to the shaping means (18) is about the cross-sectional shape of the profile to be produced, and the first heating chamber section corresponds to the cross-sectional shape and diameter of the container bore and the second heating chamber section adjacent the shaping means with respect to the direction of extrusion x, has a stepwise cross-sectional shape which tapers to about the cross-section dimension of the cross-section of the profile.

12. A device according to claim 1, wherein the container bore (12) and at least a portion of the heating chamber (22) is clad with heat resistant insulation (14).

13. A device according to claim 1, wherein an inner wall of the heating chamber facing the extrusion block material includes relief structures in the form of grooves or ribs running essentially in the direction of extrusion x.

14. A device according to claim 13, wherein grooves or ribs run in a spiral manner.

15. A device according to claim 1, further including means for cooling the metal profile (40) emerging from the shaping means to produce complete vaporisation of coolant applied to the metal profile (40).

16. A device according to claim 15, further including a pulling facility (44) to apply a tensile force (k) to the profile (40).

17. A process for manufacturing a profile (40) from an extrusion block (36) of a material that is at least in part metallic employing the device according to claim 1, including introducing the extrusion block (36) into the bore (12) of a container (10) and pressed by a stem (32) under compressive force through a shaping means (18) into a profile (40) and, prior to extrusion, the extrusion block material is pre-heated, the process including:

passing the extrusion block (36) from the container bore (12) into the heating chamber (22) of a heating facility (25) and preheating by means of inductively heated heating chamber walls (26*a*, 25*b*), and the heating chamber (22) contains at least a first and a second heating section (22*a*, 22*b*), and the second heating section (22*b*) with respect to the direction of extrusion x forming a narrowing in cross-section (9) is of smaller cross-sectional diameter than the aforegoing first heating section (22*a*), wherein the narrowing in cross-section includes a step which forms a zone of poor flow characteristics in the direction opposite the direction of extrusion x, in which pre-heated extrusion block material is held back.

18. A process according to claim 17, wherein the extrusion block material is pre-heated and brought into a part-solid/part-liquid state and the extrusion block material on entering the shaping means contains a liquid phase fraction of at most 70%.

19. A process according to claim 18, wherein the extrusion block material is pre-heated and brought into a part-solid/part-liquid state and the extrusion block material on entering the shaping means contains a liquid phase fraction between 20–60%.

20. A process according to claim 18, wherein the extrusion block material is pre-heated and brought into a part-solid/part-liquid state and the extrusion block material on entering the shaping means contains a liquid phase fraction between 40–50%.

21. A process according to claim 17, including cooling the profile (40) on leaving the shaping means (18).

22. A process according to claim 17, forming the extrusion block (36) of an alloy selected from the group consisting of a thixotropic alloy of aluminum or magnesium and a non-thixotropic hard alloy of aluminum or magnesium.

23. A process according to claim 17, including extruding the extrusion block material into a profile in a pre-heated state in a shaping chamber, passed through a cooled mould and stabilised, and passed through a die and given its final shape.

* * * * *

UNITED STATES PATENT AND TRADEMARK OFFICE

CERTIFICATE OF CORRECTION

PATENT NO. : 6,637,250 B2
DATED : October 28, 2003
INVENTOR(S) : Miroslaw Plata et al.

It is certified that error appears in the above-identified patent and that said Letters Patent is hereby corrected as shown below:

Column 8,
Lines 28 and 29, "(26a, 25b)" should be corrected to read as -- (26a, 26b) --.

Column 10,
Line 4, "(26a, 25b)" should be corrected to read as -- (26a, 26b) --.

Signed and Sealed this

Seventh Day of September, 2004

JON W. DUDAS
*Director of the United States Patent and Trademark Office*